US008662407B2

(12) United States Patent
Thomas

(10) Patent No.: US 8,662,407 B2
(45) Date of Patent: Mar. 4, 2014

(54) RAILROAD GRADE CROSSING SYSTEM AND METHOD OF ASSEMBLY

(75) Inventor: Linda Thomas, Houston, TX (US)

(73) Assignee: Linda Thomas, Houston, TX (US)

( * ) Notice: Subject to any disclaimer, the term of this patent is extended or adjusted under 35 U.S.C. 154(b) by 187 days.

(21) Appl. No.: 13/360,271

(22) Filed: Jan. 27, 2012

(65) Prior Publication Data

US 2012/0193438 A1 Aug. 2, 2012

Related U.S. Application Data

(60) Provisional application No. 61/436,672, filed on Jan. 27, 2011.

(51) Int. Cl.
*E01B 1/00* (2006.01)

(52) U.S. Cl.
USPC ..... 238/8; 238/7

(58) Field of Classification Search
USPC ..... 238/2, 6, 7, 8
See application file for complete search history.

(56) References Cited

U.S. PATENT DOCUMENTS 4,641,779 A * 2/1987 O'Brien et al. ..... 238/7
5,465,903 A * 11/1995 Davis et al. ..... 238/8
5,535,947 A * 7/1996 Hogue et al. ..... 238/2
5,535,948 A * 7/1996 Williams ..... 238/8
5,577,662 A * 11/1996 Hogue et al. ..... 238/8
5,655,711 A * 8/1997 Hull et al. ..... 238/8
5,813,602 A * 9/1998 Holland ..... 238/8
5,850,970 A * 12/1998 Hull et al. ..... 238/8
6,068,195 A * 5/2000 Gaudet ..... 238/8
6,079,630 A * 6/2000 Schroeder ..... 238/8
6,196,470 B1 * 3/2001 Neumann ..... 238/8
6,422,478 B1 * 7/2002 Lucas, Jr. ..... 238/8
6,427,925 B1 * 8/2002 Gaudet ..... 238/8
6,431,462 B1 * 8/2002 Apostolou et al. ..... 238/8
6,439,470 B1 * 8/2002 Hull ..... 238/8
6,705,536 B1 * 3/2004 Birt et al. ..... 238/8
6,871,791 B1 * 3/2005 Egan, Jr. ..... 238/8
7,677,465 B1 * 3/2010 Bruning ..... 238/8
7,988,066 B2 * 8/2011 Hughes et al. ..... 238/8
2010/0147966 A1 * 6/2010 Hughes et al. ..... 238/8
2012/0000987 A1 * 1/2012 Burkhardt et al. ..... 238/8
2012/0193438 A1 * 8/2012 Thomas ..... 238/8
2013/0026246 A1 * 1/2013 Mattson ..... 238/8

* cited by examiner

*Primary Examiner* — Jason C Smith
(74) *Attorney, Agent, or Firm* — D'Ambrosio & Menon, PLLC; Usha Menon

(57) ABSTRACT

A grade crossing system for facilitating vehicle crossing of a railway track that includes a first rail line and a second rail line is disclosed. The grade crossing system includes one or more field panels and one or more gauge panels. The one or more gauge panels may include one or more end gauge panels and one or more central gauge panels. A method for assembling a grade crossing system for facilitating vehicle crossing of a railway track that includes a first rail line and a second rail line is also disclosed.

18 Claims, 9 Drawing Sheets

RAILROAD GRADE CROSSING SYSTEM AND METHOD OF ASSEMBLY

CROSS-REFERENCE TO RELATED APPLICATION(S)

This application claims the benefit of U.S. Provisional Application No. 61/436,672, filed Jan. 27, 2011.

BACKGROUND

Rail tracks, more commonly referred to as railway tracks or railroad tracks, are surface structures that support and guide trains or other transportation vehicles. Typically, a railroad track includes: (1) two rails on which wheels of a transportation vehicle travel, (2) a series of spaced sleepers (ties) disposed transversely to the rails, and (3) a ballast bed. The ballast bed may be formed, for example, of crushed stone and may serve multiple functions including providing support for the overlying structures and facilitating drainage. The ties may be formed, for example, of either timber, concrete or composite materials and may also provide support for the rails which are most commonly formed of steel. Located underneath the ballast bed is generally a sub grade formation which may be a natural ground surface and/or a geotechnical system installed to improve ground stability and drainage.

Despite modern technological developments, flat-bottom steel rails supported on timber or pre-stressed concrete ties, which are in turn laid on a crushed stone ballast bed, remain overwhelmingly the most common form of railroad track. Generally, the rails are attached to the ties via base plates (tie plates) which function to dissipate the load across a larger surface area. The rail may be fastened to the ties with resilient fastenings, or with cut spikes, as is common in North American practice.

A railroad crossing, also known as, for example, a railroad grade crossing, railroad at-grade crossing, grade crossing, or a level crossing refers to an "at-grade" intersection of a railway track by a road or path at one level, as opposed to a crossing by way of a bridge (above-grade) or a tunnel (below-grade).

SUMMARY

A railroad grade crossing includes various structural components that are generally placed between a road surface and the sub-structures of a railroad track in order to form a substantially level and continuous surface across which vehicles may traverse the railroad tracks.

In accordance with one or more embodiments of the invention, a grade crossing system for facilitating vehicle crossing of a railway track that includes a first rail line and a second rail line is disclosed. The grade crossing system comprises one or more field panels and one or more gauge panels. Each of the field panels comprises a top surface occupying a first plane, a second surface occupying a second plane substantially parallel to the first plane, the second surface offset from the top surface in a direction substantially perpendicular to the first and second planes, a bottom surface, and a plurality of side surfaces.

In accordance with one or more embodiments of the invention, the bottom surface of each of the field panels may comprise an elevated portion and a non-elevated portion. The non-elevated portion may comprise a first planar surface. The elevated portion may comprise a second planar surface parallel to the first planar surface and an inclined surface that meets the first planar surface at a first obtuse angle and that meets the second planar surface at a second obtuse angle. When the first planar surface rests on a ground surface, the inclined surface and the second planar surface may be elevated above the ground surface forming a space between the field panel and the ground surface that is capable of accommodating any type of fastener for fastening a rail line to the ground surface.

In accordance with one or more embodiments of the invention, the plurality of side surfaces of each of the field panels may comprise a first irregular side surface, a second irregular side surface, a first side surface, a second side surface, and a third side surface. The first side surface may have a height—as measured along a same direction as a perpendicular that extends between the top surface and the first planar surface of the bottom surface—that is greater than a height of the second side surface and a height of the third side surface. The second side surface may connect the top surface and the second surface.

In addition, the first irregular side surface and the second irregular side surface may each occupy respective planes that are substantially parallel to each other. Further, the first side surface may occupy a third plane, the second side surface may occupy a fourth plane, and the third side surface may occupy a fifth plane, where the third plane, the fourth plane, and the fifth plane are substantially parallel to each other and the first plane occupied by the top surface is substantially perpendicular to the third plane occupied by the first side surface.

In accordance with one or more embodiments of the invention, the one or more gauge panels may comprise at least one end gauge panel that comprises a top surface occupying a first plane, a second surface occupying a second plane substantially parallel to the first plane, the second surface offset from the top surface in a direction substantially perpendicular to the first and second planes, a bottom surface, and a plurality of side surfaces. Moreover, the one or more gauge panels may further comprise at least one central gauge panel that comprises a top surface, a bottom surface, and at least two side surfaces, each of the side surfaces comprising a first sub-surface, and a second sub-surface, where the first sub-surface and the second sub-surface meet at an angle $\theta$, $0<\theta<180°$, and the second sub-surface meets the bottom surface at an angle $\theta_1>90°$.

In accordance with one or more embodiments of the invention, the bottom surface of each of the end gauge panels may comprise an elevated portion and a non-elevated portion. The non-elevated portion may comprise a first planar surface. The elevated portion may comprise a second planar surface parallel to the first planar surface and an inclined surface that meets the first planar surface at a first obtuse angle and that meets the second planar surface at a second obtuse angle. When the first planar surface rests on a ground surface, the inclined surface and the second planar surface may be elevated above the ground surface forming a space between the end gauge panel and the ground surface that is capable of accommodating any type of fastener for fastening a rail line to the ground surface.

In accordance with one or more embodiments of the invention, the plurality of side surfaces of each of the end gauge panels may comprise a first irregular side surface, a second irregular side surface, a first side surface, a second side surface, and a third side surface. The first side surface of the end gauge panel may have a height—as measured along a same direction as a perpendicular that extends between the top surface of the end gauge panel and the first planar surface of the bottom surface of the end gauge panel—that is greater than a height of the second side surface and a height of the third side surface. The second side surface of the end gauge panel may connect the top surface and the second surface.

In addition, the first irregular side surface and the second irregular side surface of the end gauge panel may each occupy respective planes that are substantially parallel to each other. Further, the first side surface may occupy a third plane, the second side surface may occupy a fourth plane, and the third side surface may occupy a fifth plane, where the third plane, the fourth plane, and the fifth plane are substantially parallel to each other, the first plane occupied by the top surface of the end gauge panel being substantially perpendicular to the third plane occupied by the first side surface.

In accordance with one or more embodiments of the invention, the height of the second side surface of each of the field panels may be less than a height of the second side surface of each of the end gauge panels.

According to one or more alternate embodiments of the invention, a grade crossing system for facilitating vehicle crossing of a railway track that includes a first rail line and a second rail line comprises one or more field panels and one or more gauge panels, each field panel comprising a top surface occupying a first plane, a plurality of bottom surfaces, and a plurality of side surfaces, the plurality of bottom surfaces comprising a first bottom surface configured to rest on a substantially horizontal surface and occupying a second plane substantially parallel to the first plane, and a plurality of elevated bottom surfaces comprising at least one inclined surface and at least one surface occupying a plane substantially parallel to the first and second planes.

Referring to the above-described embodiment, the plurality of side surfaces of each field panel may comprise a first irregular side surface, a second irregular side surface, first and second side surfaces occupying substantially parallel planes and being offset from each other in a direction parallel to the top surface, and an inclined side surface connecting the first and second side surfaces. In one or more embodiments, the second side surface may meet a bottom surface occupying a plane substantially parallel to the first and second planes at a rounded corner.

In the above-described embodiment, the one or more gauge panels may comprise one or more end gauge panels, with each end gauge panel comprising a top surface occupying a first plane, a second surface occupying a second plane substantially parallel to the first plane, the second surface offset from the top surface in a direction substantially perpendicular to the first and second planes, a plurality of bottom surfaces, and a plurality of side surfaces, the plurality of bottom surfaces comprising a first bottom surface configured to rest on a substantially horizontal surface and occupying a third plane substantially parallel to the first and second planes, and a plurality of elevated bottom surfaces comprising at least one inclined surface and at least one surface occupying a plane substantially parallel to the first, second, and third planes.

The plurality of side surfaces of each end gauge panel may comprise a first irregular side surface, a second irregular side surface, first and second side surfaces occupying substantially parallel planes and being offset from each other in a direction parallel to the top surface, and an inclined side surface connecting the first side surface and the second surface. In an alternate embodiment, the first side surface and the second surface may meet at a rounded corner rather than being connected by the inclined side surface.

The use of similar terminology to describe components of the field panels and gauge panels shall not be construed as requiring that the respective components share the same dimensions and surface orientation and connectivity. For example, the top surface of a field panel may or may not occupy the same plane as the top surface of an end gauge panel. Accordingly, the delineation of surface planes and their relative orientation and position with respect to other surface planes relates only to the particular component being described (e.g. a field panel, an end gauge panel, etc.)

In accordance with one or more embodiments of the invention, a method for assembling a grade crossing system for facilitating vehicle crossing of a railway track that includes a first rail line and a second rail line disposed along a ground surface, the first rail line and the second rail line each having an outer side and an inner side, is disclosed. The method comprises positioning a first field panel adjacent to the outer side of the first rail line, positioning a second field panel adjacent to the outer side of the second rail line, positioning a first end gauge panel adjacent to the inner side of the first rail line, and positioning a second end gauge panel adjacent to the inner side of the second rail line. The method may further comprise positioning a central gauge panel adjacent to the first end gauge panel and the second end gauge panel. Alternatively, no central gauge panel may be present and the first end gauge panel and the second end gauge panel may be the only panels disposed between the rails. In such embodiments, the first end gauge panel and the second end gauge panel comprise opposing side surfaces that interface smoothly.

The first field panel and the second field panel may each comprise a first portion elevated above the ground surface and forming a space there between capable of accommodating one or more fasteners for fastening the first rail line or the second rail line, respectively, to the ground surface, and a second portion that extends between the first portion and the first rail line or second rail line, respectively, the second portion preventing debris from accumulating in the space formed between the first portion and the ground surface.

These and additional embodiments of the invention will be described in further detail through reference to the following drawings in the detailed description that follows.

DETAILED DESCRIPTION

Railroad grade crossing systems for facilitating vehicle crossing of a railway track that includes a first rail line and a second rail line are disclosed. Railroad grade crossing systems in accordance with embodiments of the invention include structural components that provide distinct advantages over conventional prior art grade crossings. Railroad grade crossing systems according to embodiments of the invention comprise field and gauge panels that may be unitary, integral structures that include structural components that provide enough space between the panels and the rails to accommodate any type of fastener, as well as structural components that prevent debris from accumulating in said space, thereby eliminating the need for rubber seals used for such a purpose in conventional grade crossings.

According to one or more embodiments of the invention, the railroad grade crossing system comprises one or more field panels and one or more gauge panels. Each of the field panels may comprise a top surface occupying a first plane, a second surface occupying a second plane substantially parallel to the first plane, the second surface offset from the top surface in a direction substantially perpendicular to the first and second planes, a bottom surface, and a plurality of side surfaces. The one or more gauge panels may comprise at least one end gauge panel that comprises a first top surface occupying a first plane, a second surface occupying a second plane substantially parallel to the first plane, the second surface offset from the first surface in a direction substantially perpendicular to the first and second planes, a bottom surface, and a plurality of side surfaces. The one or more gauge panels may further comprise a central gauge panel that comprises a top surface, a bottom surface, and at least two side surfaces. A railroad grade crossing system in accordance with one or more embodiments of the invention may, when assembled between a road surface and the sub-structures of a railroad track, provides various distinct advantages over conventional railroad grade crossing systems. These advantages will be described in further detail hereinafter.

FIGS. 1A-1E depict various views of an end gauge panel in accordance with one or more embodiments of the invention. Railroad grade crossing systems according to embodiments of the invention may comprise at least two end gauge panels of the type depicted in FIGS. 1A-1E. As will be described in more detail hereinafter, a first end gauge panel of the type depicted in FIGS. 1A-1E may be positioned adjacent to an inner side of a first rail and a second end gauge panel may be positioned adjacent to an inner side of a second rail.

Figure 1B:
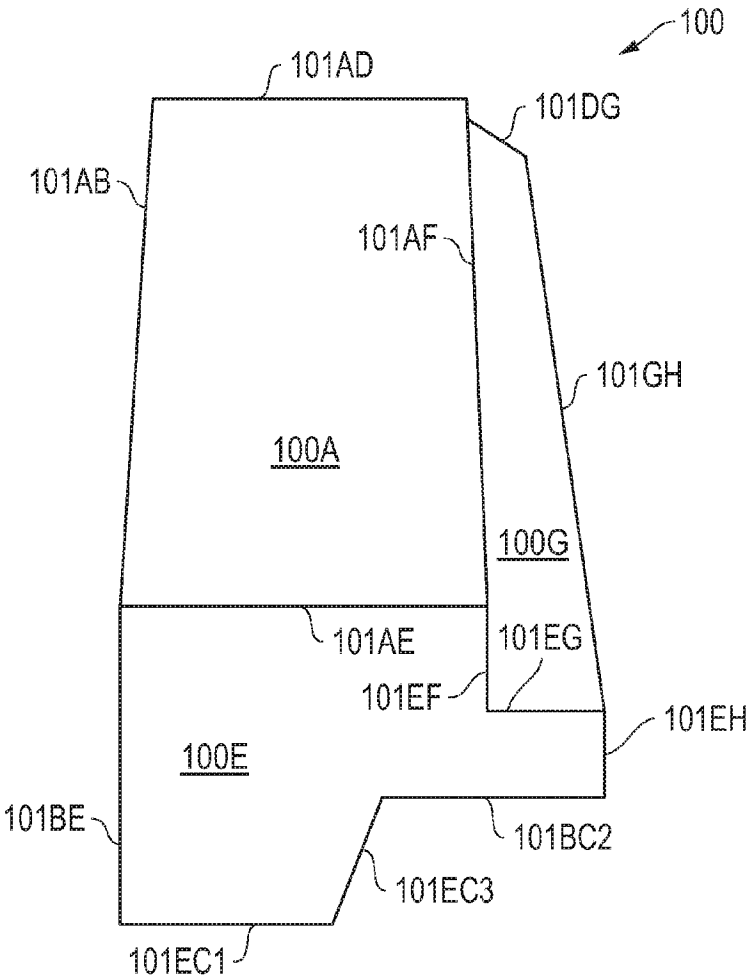
FIG. 1B is an alternate side perspective view of the end gauge panel depicted in FIG. 1A in accordance with one or more embodiments of the invention.
Figure 1A:
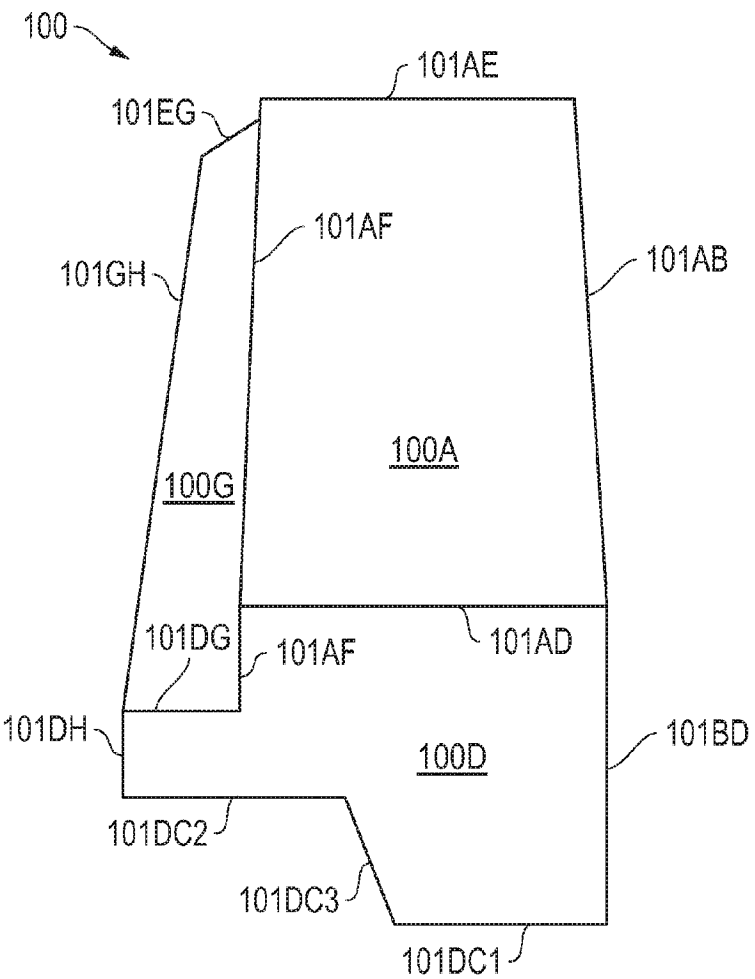
FIG. 1A is side perspective view of an end gauge panel of a railroad grade crossing system in accordance with one or more embodiments of the invention.
Figure 1E:
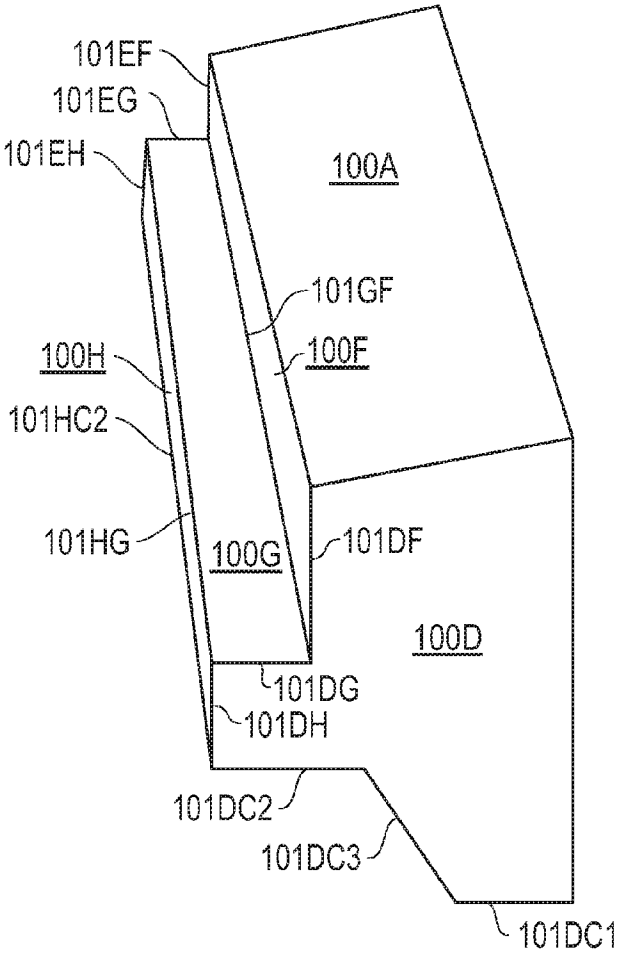
FIG. 1E is an additional side perspective view of the end gauge panel depicted in FIG. 1A in accordance with one or more embodiments of the invention.
Figure 1C:
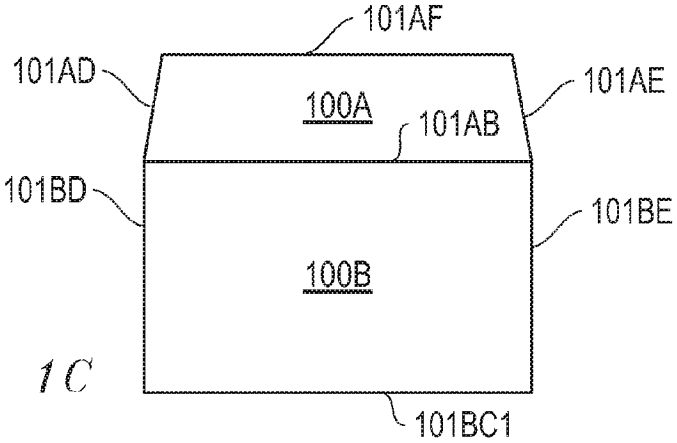
FIG. 1C is an end perspective view of the end gauge panel depicted in FIG. 1A in accordance with one or more embodiments of the invention.
Figure 1D:
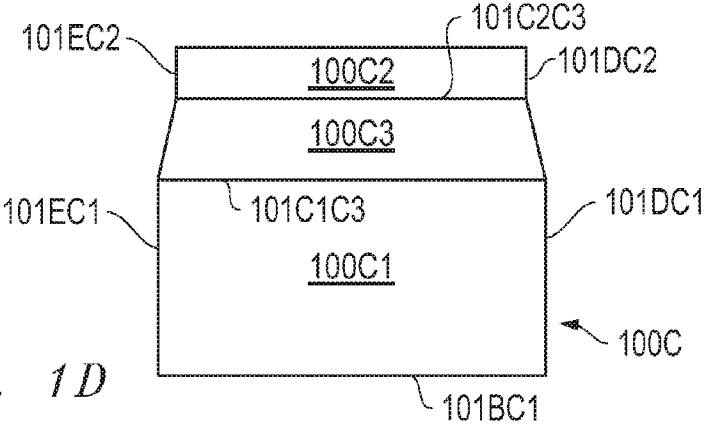
FIG. 1D is a bottom view of the end gauge panel depicted in FIG. 1A in accordance with one or more embodiments of the invention.

Referring to one or more of FIGS. 1A-1E, the end gauge panel 100 includes a top surface 100A that occupies a first plane and a second surface 100G that occupies a second plane that is substantially parallel to the first plane. The end gauge panel 100 further includes side surfaces 100B, 100F and 100H and a first irregular side surface 100D and a second irregular side surface 100E. Referring more specifically to FIG. 1D, the end gauge panel further includes a bottom surface 100C that in turn is comprised of a first planar surface 100C1, a second planar surface 100C2, and an inclined surface 100C3. The inclined surface 100C3 meets the first planar surface along edge 101C1C3 and meets the second planar surface along edge 101C2C3. An obtuse angle may be formed between the inclined surface 100C3 and the first planar surface 100C1. Similarly, an obtuse angle may be formed between the inclined surface 100C3 and the second planar surface 100C2.

The first planar surface 100C1 of the bottom surface 100C is designed to rest on a substantially horizontal surface such as, for example, a ground surface, or railroad ties overlaying a ballast bed (or other structures) disposed between the two rail lines of a railroad track. In those embodiments of the invention in which the first planar surface 100C1 is resting on a surface such as, for example, when the railroad grade crossing system is assembled on-site at a railroad grade crossing, the second planar surface 100C2 and the inclined surface 100C3 are maintained in an elevated position above the surface on which the first planar surface 100C1 rests. This particular configuration allows for the end gauge panel to accommodate fastening devices that are employed to secure the rail to ties that are generally disposed transversely to the rail. The manner in which field panels and end gauge panels accommodate fastening devices in accordance with various embodiments of the invention will be described in further detail through reference, for example, to FIG. 4.

Referring again to FIGS. 1A-1E, side surface 100B meets top surface 100A along edge 101AB and meets the first planar surface 100C1 of bottom surface 100C along edge 101BC1. Additionally, side surface 100B meets the first irregular side surface 100D along edge 101BD and meets the second irregular side surface 100E along edge 101BE.

A portion of the first irregular side surface 100D meets top surface 100A along edge 101AD and a portion of the first irregular side surface 100D meets the first planar surface 100C1 of the bottom surface 100C along edge 101DC1. In addition, a portion of the first irregular side surface 100D meets side surface 100F along edge 101DF, a portion of the first irregular side surface 100D meets side surface 100H along edge 101DH, and a portion of the first irregular side surface 100D meets the second top surface 100G along edge 101DG. In addition, a portion of the first irregular side surface 100D meets the second planar surface 100C2 of the bottom surface 100C along edge 101DC2 and a portion of the first irregular side surface 100D meets the inclined surface 100C3 of the bottom surface 100C along edge 101DC3.

Similarly, with respect to the second irregular side surface 100E, a portion of the second irregular side surface 100E meets top surface 100A along edge 101AE and a portion of the second irregular side surface 100E meets the first planar surface 100C1 of the bottom surface 100C along edge 101EC1. In addition, a portion of the second irregular side surface 100E meets side surface 100F along edge 101EF, a portion of the second irregular side surface 100E meets side surface 100H along edge 101EH, and a portion of the second irregular side surface 100E meets the second surface 100G along edge 101EG. In addition, a portion of the second irregular side surface 100E meets the second planar surface 100C2 of the bottom surface 100C2 along edge 101EC2 and a portion of the second irregular side surface 100E meets the inclined surface 100C3 of the bottom surface 100C along edge 101EC3.

Still referring to FIGS. 1A-1E, side surface 100F meets top surface 100A along edge 101AF and side surface 100F meets the second surface 100G along edge 101GF. Side surface 100H meets the second surface 100G along edge 101HG and side surface 100H meets the second planar surface 100C2 of the bottom surface 100C along edge 101HC2.

It should be noted that in accordance with one or more embodiments of the invention, top surface 100A may meet each of side surface 100F, first irregular side surface 100D, second irregular side surface 100E, and side surface 100B at substantially right angles. In addition, each of first irregular side surface 100D and second irregular side surface 100E may meet the first planar surface 100C1 of the bottom surface 100C, the second planar surface 100C2 of the bottom surface 100C, side surface 100B, side surface 100H, side surface 100F, top surface 100A, and second surface 100B at substantially right angles. Further, the first planar surface 100C1 of the bottom surface 100C may meet side surface 100B at a substantially right angle and the second planar surface 100C2 of the bottom surface 100C may meet side surface 100H at a substantially right angle. Still further, second surface 100G may meet side surface 100H and side surface 100F at substantially right angles. In one or more embodiments of the invention, the inclined surface 100C3 of the bottom surface 100C may meet the first planar surface 100C1 and the second planar surface 100C2 at obtuse angles.

As previously noted, top surface 100A and second surface 100G occupy first and second planes that are substantially parallel and may be offset with respect to each other in a direction substantially perpendicular to a surface on which the first planar surface 100C1 of the bottom surface 100C rests. Similarly, the first planar surface 100C1 and the second planar surface 100C2 may occupy substantially parallel planes and may be offset with respect to each other and with respect to top surface 100A and second surface 100B in a direction substantially perpendicular to a surface on which the first planar surface 100C1 of the bottom surface 100C rests.

In one or more embodiments of the invention, side surface 100B, side surface 100F, and side surface 100H may occupy substantially parallel planes and may be offset with respect to each other in a direction substantially parallel to a surface on which the first planar surface 100C1 rests. Similarly, the first irregular side surface 100D and the second irregular side surface 100E may occupy substantially parallel planes and may offset from each other in a direction substantially perpendicular to a direction in which side surface 100B, side surface 100F, and side surface 100H are offset from each other.

In one or more embodiments of the invention, an end gauge panel of the type shown, for example, in FIGS. 1A-1E may be formed to have dimensions that facilitate its on-site placement as part of a railroad grade crossing system. For instance, side surface 100B may be formed to have a height in the range of about 7.25" to about 8.25". Stated another way, the length of edges 101BD and 101BE may be in the range of about 7.25" to about 8.25". Further, the length of edges 101EC1 and 101DC1 may be in the range of about 11" to about 18.75" and the length of edges 101DC2 and 101EC2 may be in the range of about 1.5" to about 5.25". In addition, the first top surface 100A may have a depth in the range of about 17.25" to about 25.25". Stated another way, the length of edges 101AD and 101AE may be in range of about 17.25" to about 25.25". Additionally, the second top surface 100G may have a depth in the range of about 0" to about 3.75" (i.e. the length of edges 101DG and 101EG may be in the range of about 0" to about 3.75"). Further, the length of edges 101DH and 101EH may be in the range of about 3" to about 3.5" and the length of edges 101DF and 101EF may be in the range of about 2" to about 2.5".

It should be noted that the dimensions provided above for various portions of the end gauge panel depicted in FIGS. 1A-1E are merely exemplary and numerous other dimensions tailored to the specific requirements of the particular railroad track surface on which the gauge panel will be installed are clearly within the scope of the invention. Further, it should be noted that the end gauge panel depicted in FIGS. 1A-1E is not drawn to scale and relative dimensions of surfaces and edges may not represent actual dimensions.

Further, it should be noted that the foregoing description of a type of end gauge panel in accordance with one or more embodiments of the invention is presented merely by way of example and that alternate configurations including alternate surface shapes and dimensions and alternate angles at which adjacent surfaces meet are within the scope of the invention.

FIGS. 2A-2E depict various views of a field panel in accordance with one or more embodiments of the invention. Railroad grade crossing systems according to embodiments of the invention may comprise at least two field panels of the type depicted in FIGS. 2A-2E. As will be described in more detail hereinafter, a first field panel of the type depicted in FIGS. 2A-2E may be positioned adjacent to an outer side of a first rail and a second field panel may be positioned adjacent to an outer side of a second rail.

Figure 2B:
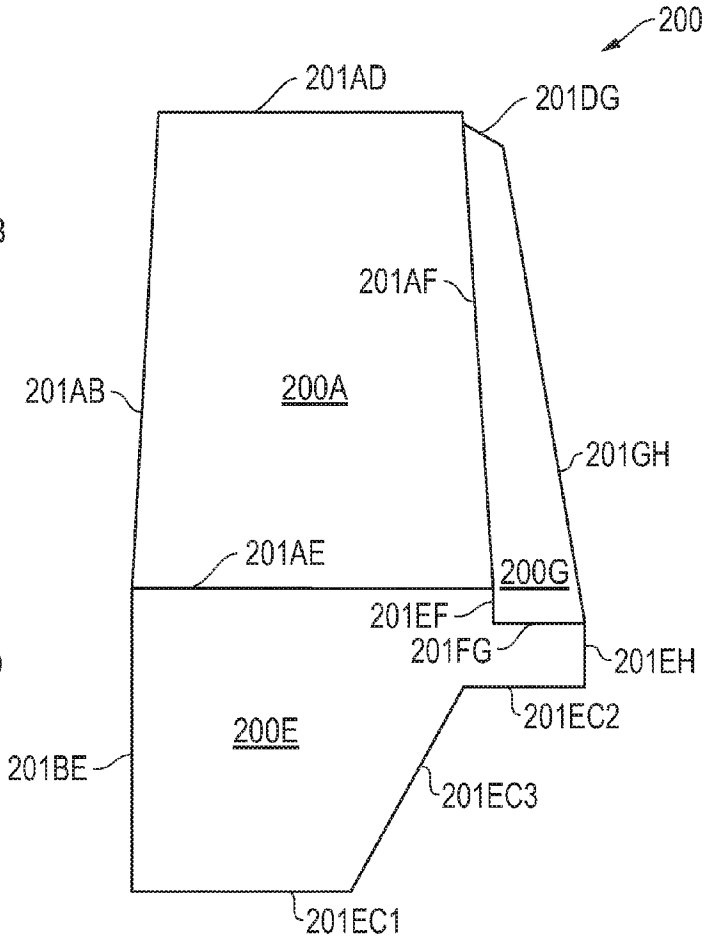
FIG. 2B is an alternate side perspective view of the field panel depicted in FIG. 2A in accordance with one or more embodiments of the invention.
Figure 2A:
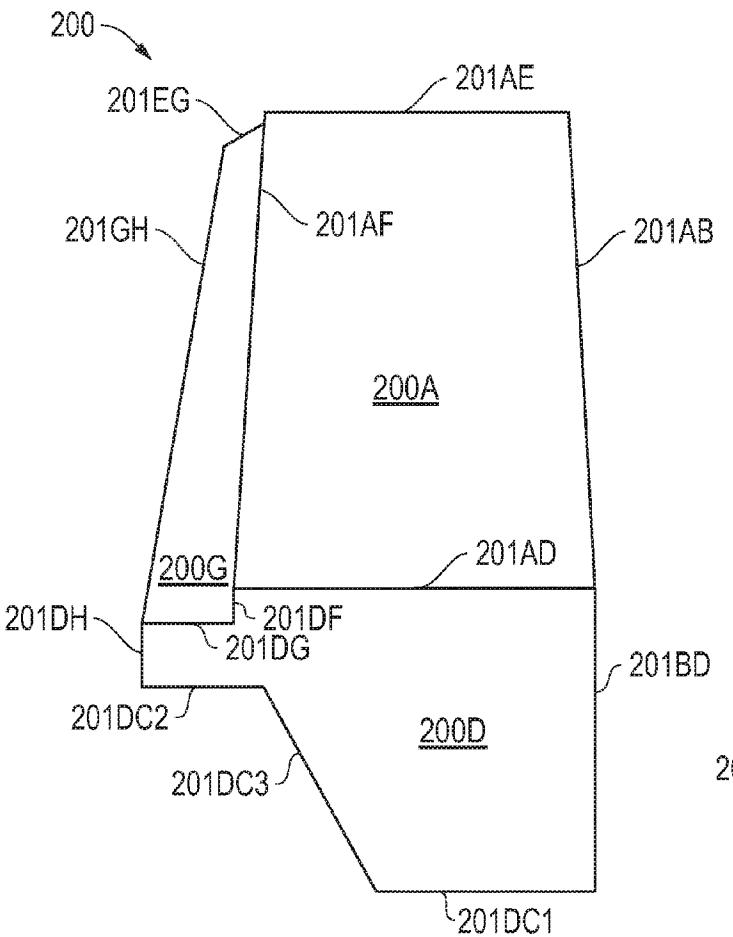
FIG. 2A is side perspective view of a field panel of a railroad grade crossing system in accordance with one or more embodiments of the invention.
Figure 2E:
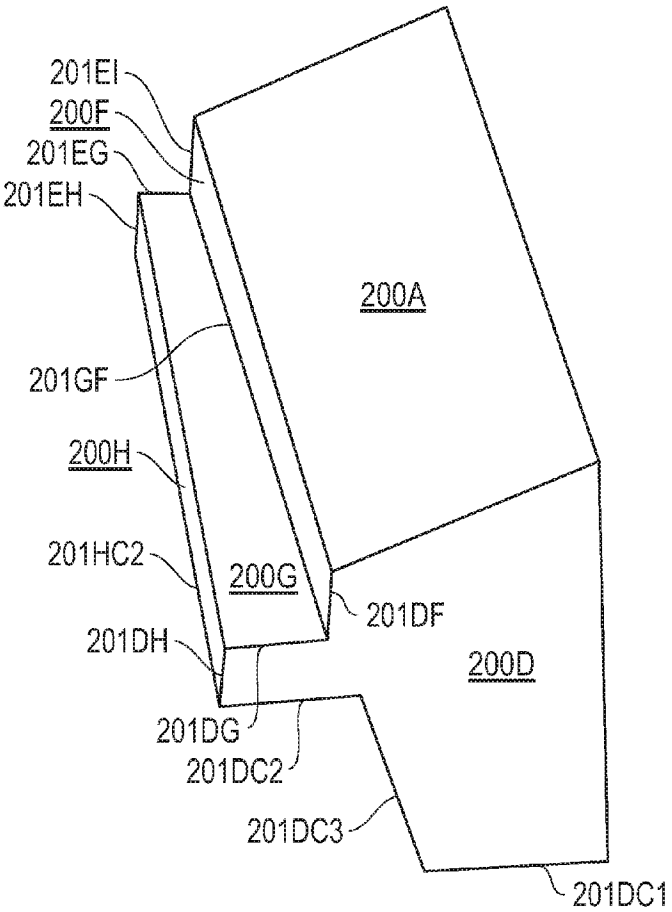
FIG. 2E is an additional side perspective view of the field panel depicted in FIG. 2A in accordance with one or more embodiments of the invention.
Figure 2C:
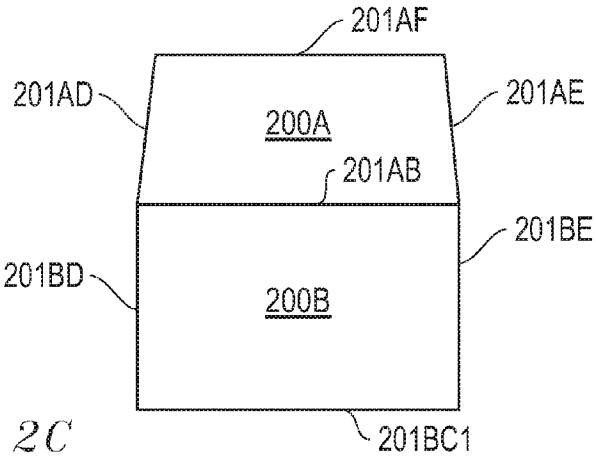
FIG. 2C is an end perspective view of the field panel depicted in FIG. 2A in accordance with one or more embodiments of the invention.
Figure 2D:
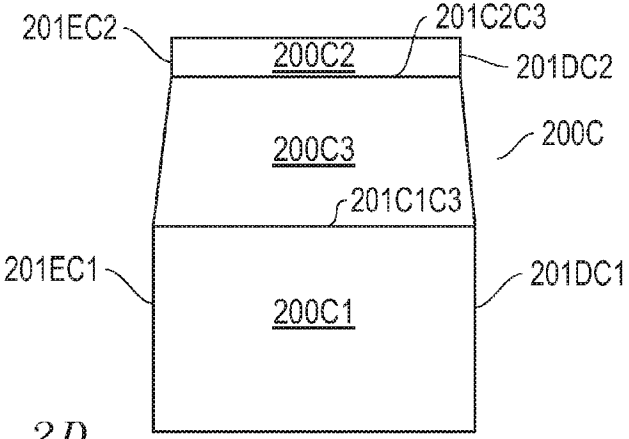
FIG. 2D is a bottom view of the field panel depicted in FIG. 2A in accordance with one or more embodiments of the invention.

Referring to one or more of FIGS. 2A-2E, the field panel 200 includes a top surface 200A occupying a first plane and a second surface 200G occupying a second plane that is substantially parallel to the first plane. The field panel 200 further includes side surfaces 200B, 200F and 200H and a first irregular side surface 200D and a second irregular side surface 200E. Referring more specifically to FIG. 2D, the field panel further includes a bottom surface 200C that in turn is comprised of a first planar surface 200C1, a second planar surface 200C2, and an inclined surface 200C3. The inclined surface 200C3 meets the first planar surface along edge 201C1C3 and meets the second planar surface along edge 201C2C3. An obtuse angle may be formed between the inclined surface 200C3 and the first planar surface 200C1. Similarly, an obtuse angle may be formed between the inclined surface 200C3 and the second planar surface 200C2.

The first planar surface 200C1 of the bottom surface 200C is designed to rest on a substantially horizontal surface such as, for example, a ground surface, or railroad ties overlaying a ballast bed (or other structures) disposed between the two rail lines of a railroad track. In those embodiments of the invention in which the first planar surface 200C1 is resting on a surface, for example, when the railroad grade crossing system is assembled on-site at a railroad grade crossing, the second planar surface 200C2 of the bottom surface 200C and the inclined surface 200C3 of the bottom surface 200C are maintained in an elevated position above the surface on which the first planar surface 200C1 rests. This particular configuration allows for the field panel to accommodate fastening devices that are employed to secure the rail to ties that are generally disposed transversely to the rail. The manner in which field panels and certain gauge panels accommodate fastening devices in accordance with embodiments of the invention will be described in further detail through reference, for example, to FIG. 4.

Referring again to FIGS. 2A-2E, side surface 200B meets top surface 200A along edge 201AB and meets the first planar surface 200C1 of bottom surface 200C along edge 101BC1. Additionally, side surface 100B meets the first irregular side surface 100D along edge 201BD and meets the second irregular side surface 200E along edge 201BE.

A portion of irregular side surface 200D meets top surface 200A along edge 201AD and a portion of irregular side surface 200D meets the first planar surface 200C1 of the bottom surface 200C along edge 201DC1. In addition, a portion of irregular side surface 200D meets side surface 200F along edge 201DF, a portion of irregular side surface 200D meets side surface 200H along edge 201DH, and a portion of irregular side surface 200D meets the second surface 200G along edge 201DG. In addition, a portion of irregular side surface 200D meets the second planar surface 200C2 of the bottom surface 200C along edge 201DC2 and a portion of the irregular side surface 200D meets the inclined surface 200C3 of the bottom surface 200C along edge 201DC3.

Similarly, with respect to irregular side surface 200E, a portion of irregular side surface 200E meets top surface 200A along edge 201AE and a portion of irregular side surface 200E meets the first planar surface 200C1 of the bottom surface 200C along edge 201EC1. In addition, a portion of irregular side surface 200E meets side surface 200F along edge 201EF, a portion of irregular side surface 200E meets side surface 200H along edge 201EH, and a portion of irregular side surface 200E meets the second top surface 200G along edge 201EG. In addition, a portion of irregular side surface 200E meets the second planar surface 200C2 of the bottom surface 200C2 along edge 201EC2 and a portion of irregular side surface 200E meets the inclined surface 200C3 of the bottom surface 200C along edge 201EC3.

Still referring to FIGS. 2A-2E, side surface 200F meets top surface 200A along edge 200AF and meets the second surface 200G along edge 200FG. Side surface 200H meets the second surface 200G along edge 200GH and meets the second planar surface 200C2 of the bottom surface 200C along edge 200HC2.

It should be noted that in accordance with one or more embodiments of the invention, top surface 200A may meet each of side surface 200F, first irregular surface 200D, second irregular surface 200E, and side surface 200B at substantially right angles. In addition, each of first irregular side surface 200D and second irregular side surface 200E may meet the first planar surface 200C1 of the bottom surface 200C, the second planar surface 200C2 of the bottom surface 200C, side surface 200B, side surface 200H, side surface 200F, top surface 200A, and second surface 200B at substantially right angles. Further, the first planar surface 200C1 of the bottom surface 200C may meet side surface 200B at a substantially right angle and the second planar surface 200C2 of the bottom surface 200C may meet side surface 200H at a substantially right angle. Still further, second surface 200G may meet side surface 200H and side surface 200F at substantially right angles. In one or more embodiments of the invention, the inclined surface 200C3 of the bottom surface 200C may meet the first planar surface 200C1 and the second planar surface 200C2 at obtuse angles.

As previously noted, top surface 200A and second surface 200G occupy first and second planes, respectively, that are substantially parallel and which may be offset with respect to each other in a direction substantially perpendicular to a surface on which the first planar surface 200C1 of the bottom surface 200C rests. Similarly, the first planar surface 200C1 and the second planar surface 200C2 may occupy substantially parallel planes and may be offset with respect to each other and with respect to top surface 200A and second surface 200B in a direction substantially perpendicular to a surface on which the first planar surface 200C1 of the bottom surface 200C rests.

In one or more embodiments of the invention, side surface 200B, side surface 200F, and side surface 200H may occupy substantially parallel planes and may be offset with respect to each other in a direction substantially parallel to a surface on which the first planar surface 200C1 rests. Similarly, first irregular side surface 200D and second irregular side surface 200E may occupy substantially parallel planes and may offset from each other in a direction substantially perpendicular to a direction in which side surface 200B, side surface 200F, and side surface 200H are offset from each other.

In one or more embodiments of the invention, the one or more field panels of the type shown, for example, in FIGS. 2A-2E may be formed to have dimensions that facilitate their on-site placement as part of a railroad grade crossing system. For instance, side surface 200B may be formed to have a height in the range of about 7.25" to about 8.25". Stated another way, the length of edges 201BD and 201BE may be in the range of about 7.25" to about 8.25". Further, the length of edges 201EC1 and 201DC1 may be in the range of about 11" to about 18.75" and the length of edges 201DC2 and 201EC2 may be in the range of about 0.5" to about 3.5". In addition, top surface 200A may have a depth in the range of about 16.75" to about 25.25". Stated another way, the length of edges 201AD and 201AE may be in the range of about 16.75" to about 25.25". Additionally, second surface 200G may have a depth in the range of about 0" to about 2.75" (i.e. the length of edges 201DG and 201EG may be in the range of about 0" to about 2.75"). Further, the length of edges 201DH and 201EH may be in the range of about 3" to about 3.5" and the length of edges 201DF and 201EF may be in the range of about 0.5" to about 0.75".

It should be noted that the dimensions provided above for various portions of the type of field panel depicted in FIGS. 2A-2E are merely exemplary and numerous other dimensions tailored to the specific requirements of the particular railroad track surface on which the gauge panel will be installed are clearly within the scope of the invention. Further, it should be noted that the field panel depicted in FIGS. 2A-2E is not drawn to scale and relative dimensions of surfaces and edges may not represent actual dimensions.

Further, it should be noted that the foregoing description of a field panel in accordance with one or more embodiments of the invention is presented merely by way of example and that other configurations including other surface shapes and other angle measurements at which adjacent surfaces meet are within the scope of the invention.

Figure 3:
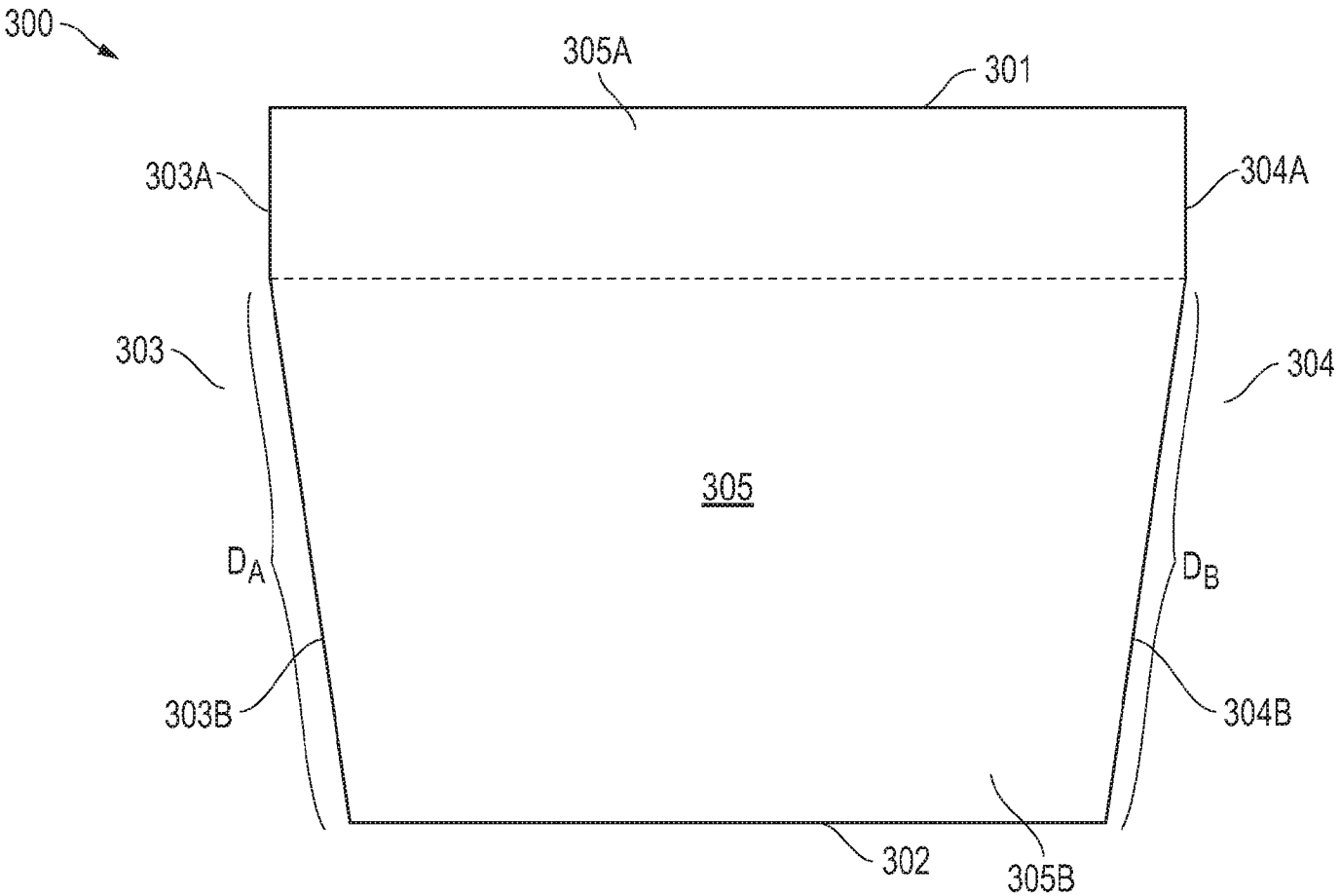
FIG. 3 is a side view of a central gauge panel of a railroad grade crossing system in accordance with one or more embodiments of the invention.

FIG. 3 provides a side view of a central gauge panel 300 in accordance with one or more embodiments of the invention. The central gauge panel 300 comprises a top surface 301 and a bottom surface 302, a first side surface 303, and a second side surface 304. The first side surface 303 comprises a partial side surface 303A that may meet the top surface 301 at a substantially perpendicular angle. The first side surface 303 also comprises a partial side surface 303B that may taper inward towards the bottom surface 302. More specifically, the partial side surface 303B may meet the partial side surface 303A at an angle θ, where $0°<\theta<180°$. In one or more embodiments of the invention, θ may be an angle slightly less than 180° degrees. Further, the partial surface 303B may meet the bottom surface 302 at a slightly obtuse angle, i.e. >90°.

Similarly, the second side surface 304 comprises a partial side surface 304A that may meet the top surface 301 at a substantially perpendicular angle. The second side surface 304 also comprises a partial side surface 304B that may taper inward towards the bottom surface 302. More specifically, the partial side surface 304B may meet the partial side surface 304A at an angle $\theta_1$, where $0<\theta_1<180°$. In one or more embodiments of the invention, $\theta_1$ may be an angle slightly less than 180°. Further, the partial surface 304B may meet the bottom surface 302 at a slightly obtuse angle, i.e. >90°. The central gauge panel 300 further includes a third side surface 305 and a fourth side surface (not shown) that opposes the third side surface 305. The third side surface 305 includes a partial side surface 305A (partial surface above dotted line) that may meet the top surface 301 at a substantially perpendicular angle. The third side surface 305 also includes a partial side surface 305B that may meet the bottom surface at slight obtuse angle.

The slight tapering of partial side surfaces 303B and 304B inward from partial side surfaces 303A and 304A, respectively, towards the bottom surface 302 facilitates on-site placement of the central gauge panel as part of a railroad grade crossing system in accordance with one or more embodiments of the invention as will be described in more detail through reference to FIG. 4.

In one or more embodiments of the invention, a central gauge panel of the type shown, for example, in FIG. 3 may be formed to have dimensions that facilitate its on-site placement as part of a railroad grade crossing system. For instance, a length of the top surface 301 (measured along a perpendicular that extends between the first side surface 303 and the second side surface 304) may be in the range of about 15.25" to about 15.75". Similarly, a length of the bottom surface 302 may be in the range of about 14.25" to about 15.75". The length of the bottom surface 302 may be slightly less than the length of the top surface due to the tapering of the partial side surfaces 303B and 304B. In addition, the central gauge panel may have a height (measured along a perpendicular that extends between the top surface 301 and the bottom surface 302) in the range of about 7.25" to about 8.25". The partial side surfaces 303A and 304A may have heights in the range of about 7.25" to about 8.25" as measured along a same direction as the perpendicular that extends between the top surface 301 and the bottom surface 302. Further, a shortest distance $D_A$ measurable from where the partial side surface 303B meets the partial side surface 303A and where the partial side surface 303B meets the bottom surface 302 may be in the range of about 7.25" to about 8.3". Similarly, a shortest distance $D_B$ measurable from where the partial side surface 304B meets the partial side surface 304A and where the partial side surface 304B meets the bottom surface 302 may be in the range of about 7.25" to about 8.3". Due to the tapering of the partial side surfaces 303B and 304B, the sum of the height of partial side surface 303A and $D_A$ (or alternatively, the sum of partial side surface 304A and $D_B$) may be greater than the height of the perpendicular that extends between the top surface 301 and the bottom surface 302.

It should be noted that the dimensions provided above for various portions of the central gauge panel depicted in FIG. 3 are merely exemplary and numerous other dimensions tailored to the specific requirements of the particular railroad track surface in connection with which the central gauge panel will be installed are clearly within the scope of the invention. Further, it should be noted that the central gauge panel depicted in FIG. 3 is not drawn to scale and relative dimensions of surfaces and edges may not represent actual dimensions in practice.

Figure 4:
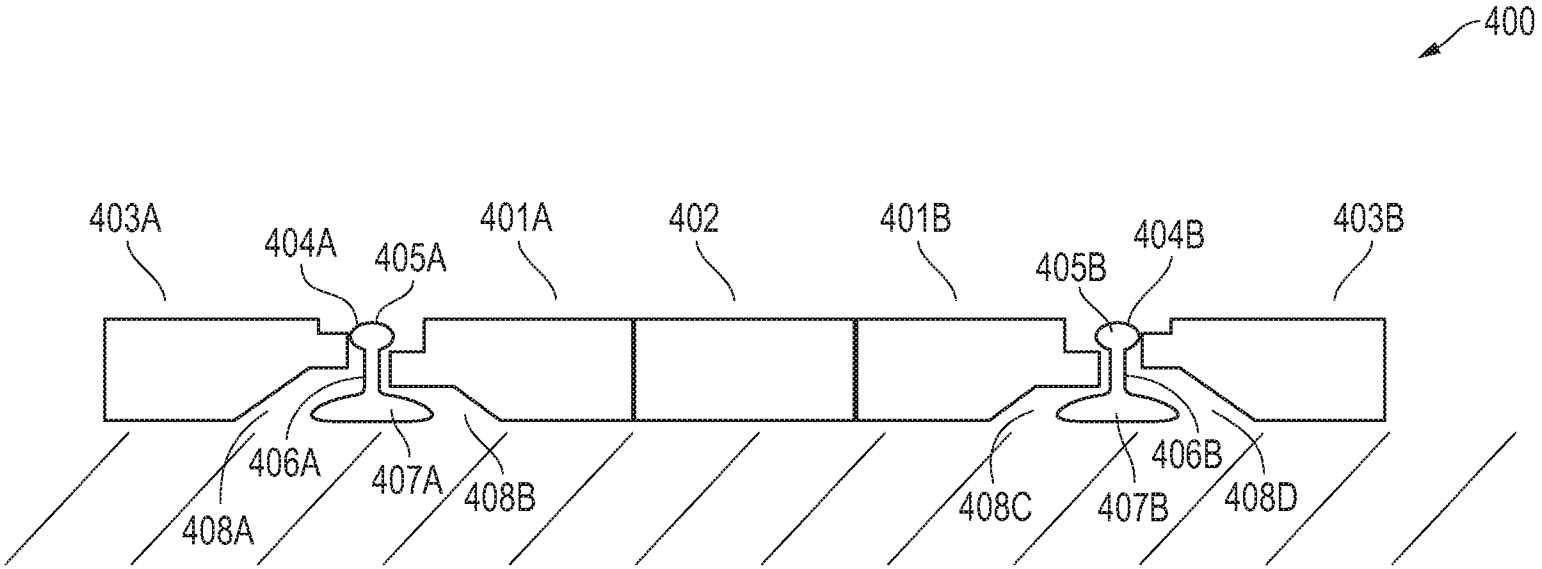
FIG. 4 is a side view of a railroad grade crossing system in assembled form in accordance with one or more embodiments of the invention.

FIG. 4 depicts a side cross-sectional view of a railroad grade crossing system 400 in accordance with one or more embodiments of the invention. The grade crossing system 400 comprises a first field panel 403A disposed adjacent to an outer side of a first rail 404A and a second field panel 403B disposed adjacent to an outer side of a second rail 404B. The grade crossing system 400 further comprises a first end gauge panel 401A disposed adjacent to an inner side of the first rail 404A and a second end gauge panel 401B disposed adjacent to an inner side of a second rail 404B. In addition, the grade crossing system 400 may comprise a central gauge panel 402 disposed adjacent to the first gauge panel 401A and the second gauge panel 401B.

It should be noted that although FIG. 4 depicts an embodiment that includes two end gauge panels and one central gauge panel, other embodiments and configurations are clearly within the scope of the invention. For example, a grade crossing system in accordance with one or more embodiments of the invention may comprise two end gauge panels and two field panels alone. That is, in certain embodiments of the invention, no central gauge panel may be present, but rather the two end gauge panels may be the only panels positioned between the rails. In such embodiments, the two end gauge panels may comprise opposing side surfaces that interface smoothly so as to minimize any gaps between the two end gauge panels. Alternatively, a grade crossing system according to various embodiments of the invention may include two field panels, two end gauge panels, and a plurality of central gauge panels. Numerous other configurations are also within the scope of the invention.

The field panels 403A, 403B, end gauge panels 401A, 401B, and central gauge panel 402 may be formed of a composite material that may include various recycled materials such as recycled plastics. The panels may be integrally formed through extrusion into pre-formed molds. That is, each panel may be formed as a single, unitary, integral composite structure.

The first rail 404A and the second rail 404B may be, for example, flat-bottom rails, bullhead rails, or any other type of rail known in the art. The first rail 404A includes a head 405A, a web 406A, and a foot 407A. Similarly, the second rail 404B includes a head 405B, a web 406B, and a foot 407B. Various fasteners such as elastic fasteners, cut spikes, or any other fastener known in the art may be used to secure the foots 407A, 407B of the first rail 404A and the second rail 404B, respectively, to structures such as ties that may be disposed beneath and transversely to the rails.

In accordance with one or more embodiments of the invention, the particular configurations and shapes of the first field panel 403A and the second field panel 403B as well as the first end gauge panel 401A and the second end gauge panel 401B provide various distinct advantages over conventional grade crossing systems. As described through reference to FIGS. 2A-2E, each of the field panels includes an inclined surface 200C3 that meets the first planar surface along edge 201C1C3 at a first obtuse angle and that meets the second planar surface 200C2 along edge 201C2C3 at a second obtuse angle. This construction creates, for example, an open space 408A between field panel 403A and rail 404A when field panel 403A is installed adjacent to an outer side of the rail 404A. Similarly, an open space 408D is created between field panel 403B and rail 404B when field panel 403B is installed adjacent to an outer side of the rail 404B. A similar construction with respect to the end gauge panels 401A and 401B creates open spaces 408B and 408C between end gauge panel 401A and rail 404A and end gauge panel 401B and rail 404B, respectively.

Open spaces 408A, 408B, 408C, and 408D provide spacing that is capable of accommodating any type of fastener such as elastic fasteners, cut spikes, and so forth, that may be used to secure the rails to the underlying ties and other structures. Conventional grade crossing systems are incapable of accommodating all types of fasteners that may be used to secure rail lines to underlying sub-structures.

The field panels 403A, 403B, which may be of the type described through reference to FIGS. 2A-2E, include portions that are defined by the second surface 200G, side surface 200H, and those portions of the first irregular side surface 200D and the second irregular side surface 200E that extend beyond side surface 200F. These portions of the field panels 403A, 403B serve to prevent debris from entering and damaging the lower structures of rails 404A and 404B, respectively. In conventional grade crossing systems, separate rubber interfaces may be joined or attached to the panels to prevent the accumulation of debris around the rails. However, such rubber interfaces are not as effective at preventing the accumulation of debris as a portion of a panel itself that is integrally formed with the panel. Further, rubber interfaces must be separately manufactured and installed, thereby increasing the associated labor and manufacturing costs. On the other hand, a portion of the panel itself that more effectively prevents the accumulation of debris around the rail provides a distinct advantage over conventional systems.

Similarly, end gauge panels 401A, 401B, which may be of the type described through reference to FIGS. 1A-1E, include portions that are defined by the second surface 100G, side surface 100H, and those portions of the first irregular side surface 100D and the second irregular side surface 100E that extend beyond side surface 100F. These portions of the end gauge panels serve a similar purpose as the corresponding portions of the field panels described above of preventing the entry and accumulation of debris around the lower structures of the rails.

In one or more embodiments of the invention, referring to FIGS. 1A-1E and 2A-2E, the height of side surface 200F of a field panel (generally equivalent to the length of edge 201DF or 201EF) may be less than a height of side surface 100F (generally equivalent to the length of edge 101DF or 101EF) of an end gauge panel in order to accommodate the flanges of vehicle wheels along the inner sides of the rails. Further, in one or more embodiments of the invention, the length of the second planar surface 100C2 of the bottom surface 100C of an end gauge panel (generally equivalent to the length of edge 101EC2 or 101DC2) may be greater than the length of the second planar surface 200C2 of the bottom surface 200C of a field panel (generally equivalent to the length of edge 201EC2 or 201DC2). Moreover, in one or more embodiments of the invention, a length of the inclined surface 100C3 of the bottom surface 100C of an end gauge panel (generally equivalent to the length of edge 101EC3 or 101DC3) may be less than the length of the inclined surface 200C3 of the bottom surface 200C of a field panel (generally equivalent to the length of edge 201EC3 or 201DC3).

The top surface of at least one field panel, the top surface of at least one end gauge panel, and/or the top surface of at least one central gauge panel may have a raised surface pattern that is designed to prevent vehicle skidding as vehicles traverse the grade crossing. The raised surface pattern may be stamped onto the top surfaces of the panels after the panels have been formed, or alternatively, may be formed integrally as part of the molding process by which the panels are formed.

A railroad grade crossing system in accordance with one or more embodiments of the invention provides additional advantages over conventional systems such as a reduced number of panels. For example, railroad grade crossing systems according to embodiments of the invention may include two field panels and two end gauge panels. The fewer number of panels necessarily results in lower manufacturing costs and lower labor costs in connection with assembling the panels. In addition, the fewer number of panels results in less stress points between adjacent panels and thus contributes to an increase in the overall integrity of the grade crossing system.

Figure 5:
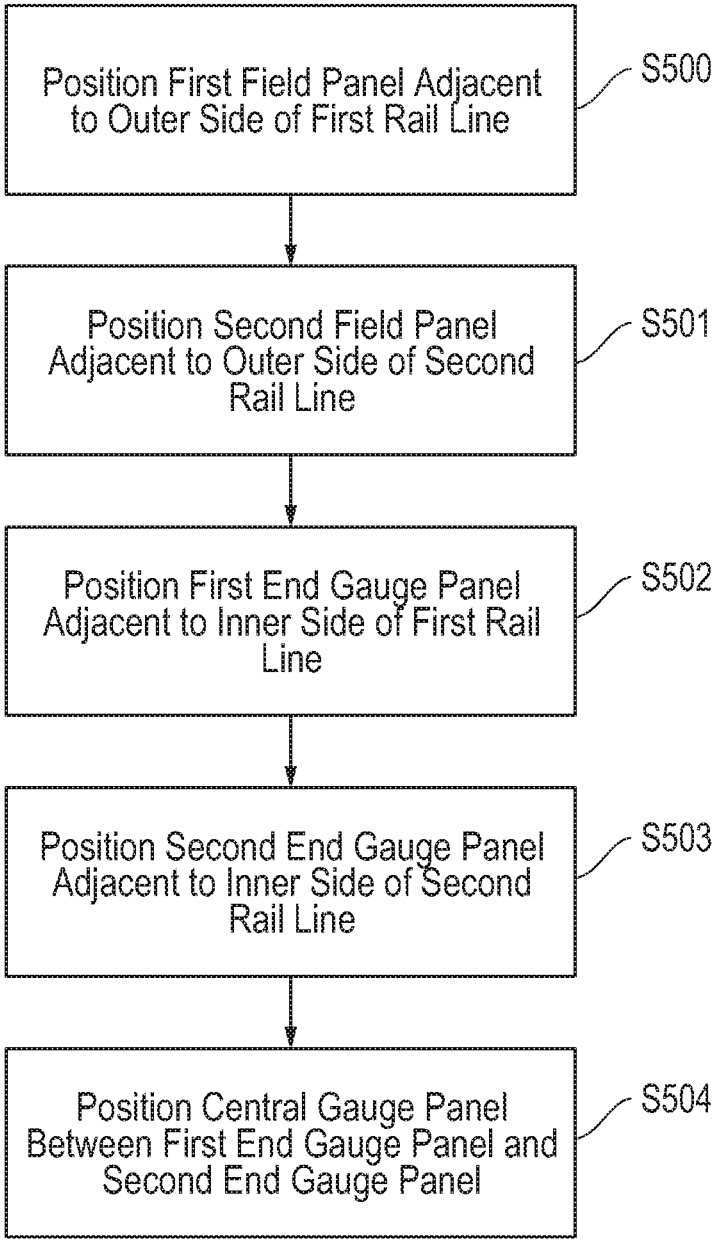
FIG. 5 is a flowchart of a method for assembling a railroad grade crossing system in accordance with one or more embodiments of the invention.

FIG. 5 depicts a flow chart of a method for installing or assembling a railroad grade crossing system according to one or more embodiments of the invention. In step S500, a first field panel is positioned adjacent to an outer side of the first rail line. In step S501, a second field panel is positioned adjacent to an outer side of the second rail line. In steps S502 and S503, respectively, a first end gauge panel is positioned adjacent to an inner side of the first rail line and a second end gauge panel is positioned adjacent to an inner side of the second rail line. In step S504, a central gauge panel is positioned adjacent to the first end gauge panel and the second end gauge panel. The inward tapering of the side surfaces of the central gauge panel (as described in detail through reference to FIG. 3) facilitates the positioning of the central gauge panel between the first end gauge panel and the second end gauge panel. As previously noted, in certain embodiments, the central gauge panel may be absent and only two end gauge panels may be positioned between the rails.

The average density of a field panel and/or an end gauge panel is approximately 64 lbs. per cubic foot. End gauge panels in accordance with embodiments of the invention weight approximately 793 lbs., while field panels may vary depending on the length of the ties used under the crossings (e.g. 8'6", 9', or 10' ties), and generally range anywhere from 535 lbs. to 780 lbs. As such, because the panels may be too unwieldy to manipulate manually, lifting devices may be employed to facilitate the lifting and placement of the panels. Such lifting devices also facilitate removal and re-installation of panels during maintenance operations. An example of a lifting device that may be employed is an insert provided within the top surface of a panel to which a lifting chain may be removably attached for positioning and placement of the panel. The panels may be lagged to either timber or composite ties using lag screws or any other fastening device. It should be noted that the above densities and weights are provided purely by way of example and that the panels may be formed to have any suitable density and/or weight.

Figure 6A:
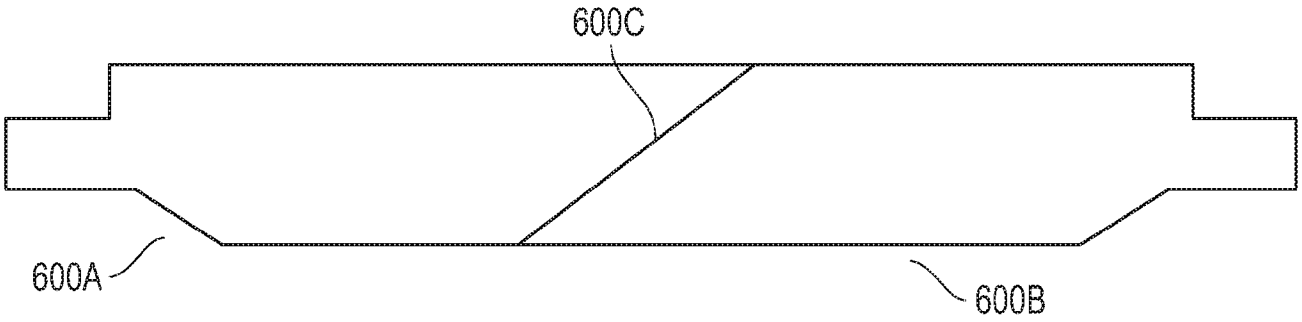
FIGS. 6A-6B depict various gauge panel configurations in accordance with one or more alternate embodiments of the invention.
Figure 6B:
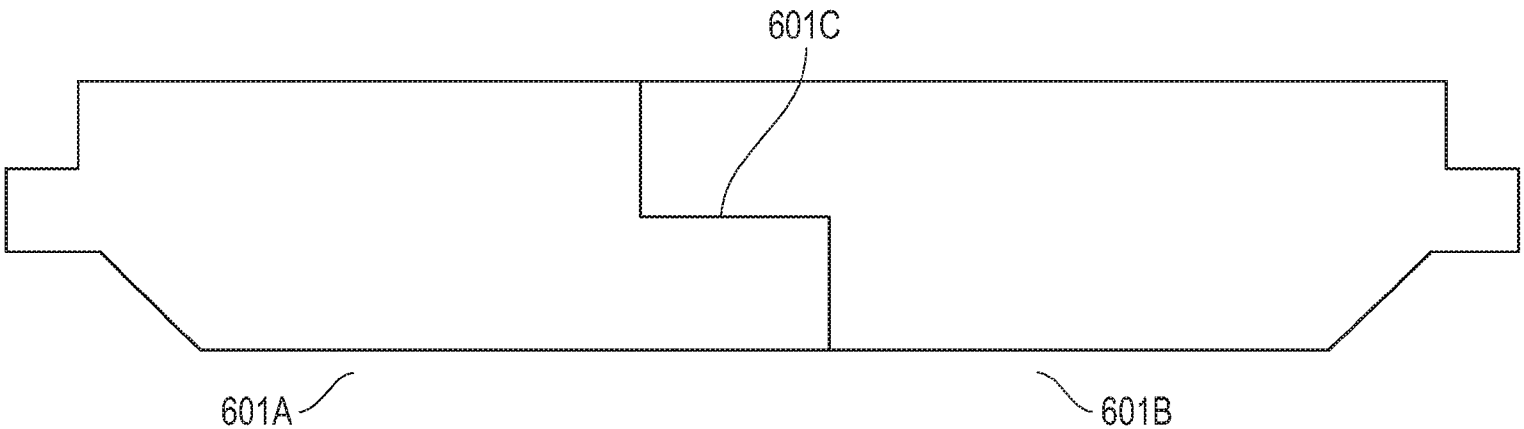

FIGS. 6A-6B depict gauge panel configurations in accordance with one or more alternate embodiments of the invention. As discussed above at paragraph [0061], embodiments in which the grade crossing system does not comprise a central gauge panel are within the scope of the invention. In certain embodiments of the invention in which a central gauge panel is not present, each end gauge panel may be formed so as to mateably interface with an opposing end gauge panel when assembled as part of a grade crossing system.

Referring to FIG. 6A, a first end gauge panel 600A and a second end gauge panel 600B are configured so as to form interface 600C when assembled as part of a grade crossing system according to one or more embodiments of the invention. Each end gauge panel may be provided with an inclined surface that connects the top surface of the end gauge panel with the first planar surface of the bottom surface of the panel. Stated differently, the side surface of the panel that meets the top surface and the first planar surface of the bottom surface at substantially right angles in accordance with certain embodiments of the invention described earlier may be replaced with an inclined surface. These inclined surfaces of each end gauge panel may be formed so as to mateably contact each other at interface 600C when installed as part of a grade crossing system according to embodiments of the invention.

Numerous alternative types of end gauge panel interfaces are within the scope of the current disclosure. FIG. 6B depicts an alternate end gauge panel interface. A first end gauge panel 601A and a second end gauge panel 601B are structurally configured so as to mateably contact each other at interface 601C when assembled as part of a grade crossing system according to embodiments of the invention. The interface 601C may be formed by forming each end gauge panel to include two side surfaces that are substantially parallel to each other, where one side surface meets the top surface, the other side surface meets the first planar surface of the bottom surface, and the two side surfaces are separated by a perpendicular surface that connects the two side surfaces. Two end gauge panels having the aforementioned configuration may then form an interlocking structure via interface 601C when installed as part of a grade crossing system according to embodiments of the inventions.

In alternate embodiments of the invention in which no central gauge panel is present, the end gauge panels may comprise substantially planar opposing side surfaces that do not mateably interface in the manner depicted in FIGS. 6A-6B.

The present invention has been described through reference to various exemplary embodiments. However, numerous other embodiments of the invention exist in which the dimensions of surfaces and edges of the panels, the number of surfaces, the relative orientation of surfaces, and so forth may be varied.

Figure 7A:
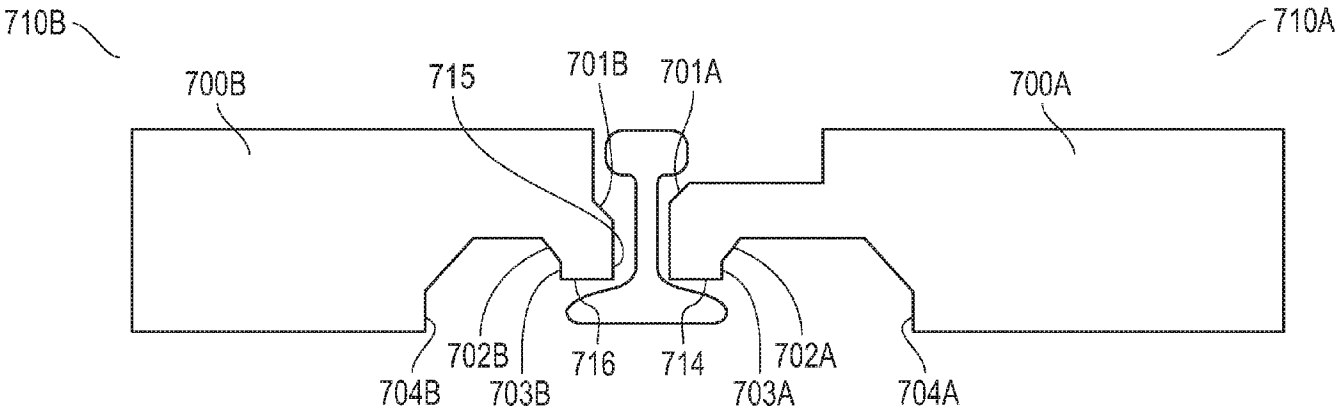
FIGS. 7A-7B depict side views of aspects of a railroad grade crossing system having end gauge panels and field panels in accordance with one or more alternate embodiments of the invention.
Figure 7B:
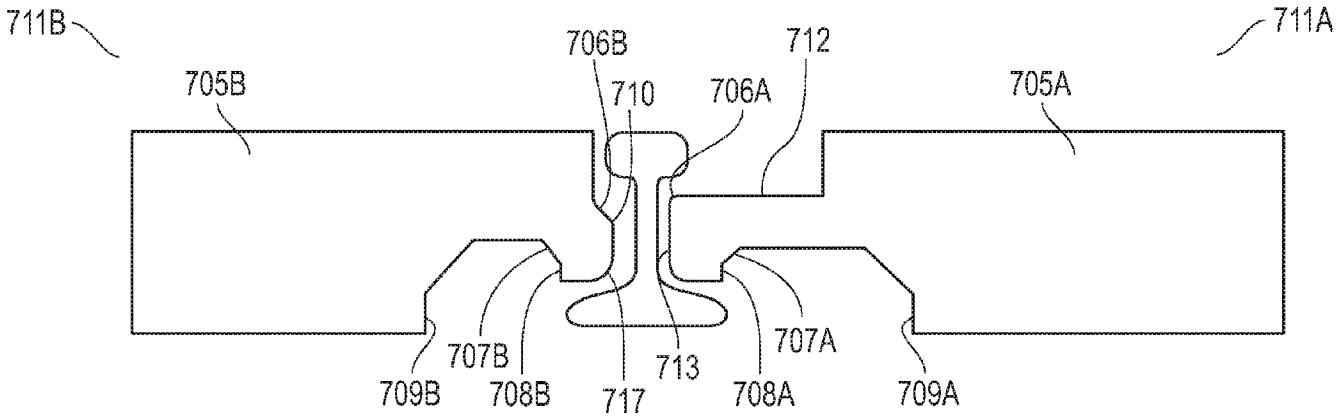

For example, FIGS. 7A and 7B depict side views of portions of a railroad grade crossing system comprising end gauge panels and field panels in accordance with alternate embodiments of the invention. For the sake of convenience, only the end gauge panel and field panel disposed adjacent to a first rail line are shown. In one or more embodiments, the end gauge panel and field panel disposed adjacent to the second rail line would have substantially the same dimensions and relative orientation and size of surfaces as the end gauge panel and field panel depicted in FIGS. 7A-7B, respectively.

The number of surfaces, relative orientation of surfaces, and dimensions of the end gauge panels and field panels depicted in FIGS. 7A-7B may differ from those of previously disclosed embodiments. For example, the irregular side surface 700A of the end gauge panel 710A depicted in FIG. 7A includes inclined surfaces 701A and 702A not present in previously described embodiments. Similarly, irregular side surface 700B of field panel 710B depicted in FIG. 7A includes inclined surfaces 701B and 702B not present in previously disclosed embodiments. End gauge panel 710A further includes additional side surfaces 703A and 704A and field panel 710B further includes additional side surfaces 703B and 704B not present in previously described embodiments. The relative orientation and placement of surfaces of the end gauge panel 710A and field panel 710B depicted in FIG. 7A differ compared to previously described embodiments. In addition, the dimensions of the surfaces and edges of the end gauge panel 710A and the field panel 710B depicted in FIG. 7A may differ from those of previously disclosed embodiments.

Referring now to FIG. 7B, in an alternate embodiment, end gauge panel 711A includes inclined surface 707A and side surface 709A that roughly correspond to inclined surface 702A and side surface 704A, respectively, of end gauge panel 710A of the embodiment depicted in FIG. 7A. Similarly, field panel 711B includes inclined surface 707B and side surface 709B that roughly correspond to inclined surface 702B and side surface 704B, respectively, in field panel 710B of the embodiment depicted in FIG. 7A. Additionally, field panel 711B includes inclined surface 706B and side surface 708B that roughly correspond to inclined surface 701B and side surface 703B, respectively, of field panel 710B of the embodiment depicted in FIG. 7A.

The field panel 711B and the end gauge panel 711A of the embodiment depicted in FIG. 7B differ in various respects from the field panel 710B and the end gauge panel 710A of the embodiment depicted in FIG. 7A. For example, inclined surface 701A of the end gauge panel 710A is not present in end gauge panel 711A. Instead, a rounded corner 706A may be formed at the juncture between horizontal surface 712 and a vertical portion of surface 713. Further, surface 713 of end gauge panel 711A has a curved portion that meets side surface 708A, which is not present in the embodiment depicted in FIG. 7A. Moreover, the field panel 711B depicted in FIG. 7B includes a surface 717 comprising a substantially vertical portion and an arcuate portion. Surface 717 of field panel 711B may be provided in lieu of the combination of surfaces 715 and 716 present in the field panel 710B of the embodiment depicted in FIG. 7A.

Although the invention has been described with respect to certain embodiments, one of ordinary skill in the art will understand and appreciate that numerous other embodiments including numerous panel configurations, shapes, and dimensions are within the scope of the invention. It should be further noted that the relative dimensions of surfaces and edges of each type of panel as well as any of the relative orientations of panel surfaces depicted in the Figures are not depicted to scale and may vary considerably across embodiments of the invention.

What is claimed is:

1. A grade crossing system for facilitating vehicle crossing of a railway track that includes a first rail line and a second rail line, the grade crossing system comprising:

one or more field panels; and one or more gauge panels, each of the field panels comprising:

a top surface occupying a first plane, a second surface occupying a second plane substantially parallel to the first plane, the second surface offset from the top surface in a direction substantially perpendicular to the first and second planes, a bottom surface, the bottom surface of each of the field panels comprising:

an elevated portion; and a non-elevated portion, the non-elevated portion comprising a first planar surface;

the elevated portion comprising:

a second planar surface substantially parallel to the first planar surface; and an inclined surface meeting the first planar surface at a first obtuse angle and meeting the second planar surface at a second obtuse angle, wherein when the first planar surface rests on a ground surface, the inclined surface and the second planar surface are elevated above the ground surface, and a plurality of side surfaces.

2. The grade crossing system of claim 1, wherein at least one of the field panels and gauge panels are formed of one or more recycled materials.

3. The grade crossing system of claim 1, the plurality of side surfaces of each of the field panels comprising:
a first irregular side surface,
a second irregular side surface, and
a first, second and third side surfaces,
the first side surface having a height, measured along a same direction as a perpendicular that extends between the top surface and the first planar surface of the bottom surface, greater than a height of the second side surface and greater than a height of the third side surface,
the second side surface connecting the top surface and the second surface,
the first irregular side surface and the second irregular side surface each occupying respective planes that are substantially parallel to each other,
the first side surface occupying a third plane, the second side surface occupying a fourth plane, and third side surface occupying a fifth plane, the third plane, the fourth plane, and the fifth plane each being substantially parallel to each other, and
the first plane being substantially perpendicular to the third plane.

4. The grade crossing system of claim 3, the one or more gauge panels comprising at least one end gauge panel that comprises:
a top surface occupying a first plane,
a second surface occupying a second plane substantially parallel to the first plane, the second surface offset from the top surface in a direction substantially perpendicular to the first and second planes,
a bottom surface, and
a plurality of side surfaces.

5. The grade crossing system of claim 4, the bottom surface of each of the end gauge panels comprising:
an elevated portion; and
a non-elevated portion,
the non-elevated portion comprising a first planar surface;
the elevated portion comprising:
a second planar surface substantially parallel to the first planar surface; and
an inclined surface meeting the first planar surface at a first obtuse angle and meeting the second planar surface at a second obtuse angle,
wherein when the first planar surface rests on a ground surface, the inclined surface and the second planar surface are elevated above the ground surface.

6. The grade crossing system of claim of 5, the plurality of side surfaces of each of the end gauge panels comprising:
a first irregular side surface,
a second irregular side surface, and
first, second, and third side surfaces,
the first side surface having a height, measured along a same direction as a perpendicular that extends between the top surface and the first planar surface of the bottom surface, greater than a height of the second side surface and greater than a height of the third side surface,
the second side surface connecting the top surface and the second surface,
the first irregular side surface and the second irregular side surface each occupying respective planes that are substantially parallel to each other,
the first side surface occupying a third plane, the second side surface occupying a fourth plane, and third side surface occupying a fifth plane, the third plane, the fourth plane, and the fifth plane being substantially parallel to each other, and
the first plane being substantially perpendicular to the third plane.

7. The grade crossing system of claim 6, wherein the height of the second side surface of each of the field panels is less than a height of the second side surface of each of the end gauge panels.

8. The grade crossing system of claim 7, wherein a shortest distance from a point at which the inclined surface of the bottom surface of a field panel meets the second planar surface of the bottom surface of the field panel and a point at which the inclined surface meets the first planar surface of the field panel is greater than a shortest distance from a point at which the inclined surface of the bottom surface of an end gauge panels meets the second planar surface of the bottom surface of the end gauge panel and a point at which the inclined surface meets the first planar surface of the end gauge panel.

9. The grade crossing system of claim 4, the one or more gauge panels comprising at least one central gauge panel that comprises:
a top surface,
a bottom surface, and
first and second side surfaces, each side surface comprising:
a first sub-surface, and
a second sub-surface,
wherein,
the first sub-surface and the second sub-surface meet at an angle $\theta$, where $0<\theta<180°$, and
the second sub-surface meets the bottom surface at angle $\theta_1>90°$.

10. A grade crossing system for facilitating vehicle crossing of a railway track that includes a first rail line and a second rail line, the grade crossing system comprising:
one or more field panels; and
one or more gauge panels,
each field panel comprising:
a top surface occupying a first plane,
a plurality of bottom surfaces, and
a plurality of side surfaces,
the plurality of bottom surfaces comprising:
a first bottom surface configured to rest on a substantially horizontal surface and occupying a second plane substantially parallel to the first plane, and
a plurality of elevated bottom surfaces comprising at least one inclined surface and at least one surface occupying a plane substantially parallel to the first and second planes,
the one or more gauge panels comprising one or more end gauge panels, each end gauge panel comprising:
a top surface occupying a first plane,
a second surface occupying a second plane substantially parallel to the first plane, the second surface offset from the top surface in a direction substantially perpendicular to the first and second planes,
a plurality of bottom surfaces, and
a plurality of side surfaces,
the plurality of bottom surfaces comprising:
a first bottom surface configured to rest on a substantially horizontal surface and occupying a third plane substantially parallel to the first and second planes, and
a plurality of elevated bottom surfaces comprising at least one inclined surface and at least one surface occupying a plane substantially parallel to the first, second, and third planes.

11. The grade crossing system of claim 10, wherein at least one of the fields panels and gauge panels are formed from one or more recycled materials.

12. The grade crossing system of claim 10, the plurality of side surfaces of each field panel comprising:

a first irregular side surface;

a second irregular side surface;

first and second side surfaces occupying substantially parallel planes and being offset from each other in a direction parallel to the top surface; and an inclined side surface connecting the first and second side surfaces.

13. The grade crossing system of claim 12, wherein the second side surface meets a bottom surface occupying a plane substantially parallel to the first and second planes at a rounded corner.

14. The grade crossing system of claim 10, the plurality of side surfaces of each end gauge panel comprising:

a first irregular side surface;

a second irregular side surface;

first and second side surfaces occupying substantially parallel planes and being offset from each other in a direction parallel to the top surface; and an inclined side surface connecting the first side surface and the second surface.

15. The grade crossing system of claim 10, the plurality of side surfaces of each end gauge panel comprising:

a first irregular side surface;

a second irregular side surface; and first and second side surfaces occupying substantially parallel planes and being offset from each other in a direction parallel to the top surface, wherein the first side surface and the second surface meet at a rounded corner.

16. A method for assembling a grade crossing system for facilitating vehicle crossing of a railway track that includes a first rail line and a second rail line disposed along a ground surface, the first rail line and the second rail line each having an outer side and an inner side, the method comprising:

positioning a first field panel adjacent to the outer side of the first rail line;

positioning a second field panel adjacent to the outer side of the second rail line;

positioning a first end gauge panel adjacent to the inner side of the first rail line; and positioning a second end gauge panel adjacent to the inner side of the second rail line, wherein the first field panel and the second field panel each comprise:

a first portion elevated above the ground surface and forming a space there between capable of accommodating one or more fasteners for fastening the first rail line or the second rail line, respectively, to the ground surface, and a second portion that extends between the first portion and the first rail line or second rail line, respectively, the second portion preventing debris from accumulating in the space formed between the first portion and the ground surface, wherein each of the end gauge panels comprises:

a top surface occupying a first plane, a second surface occupying a second plane substantially parallel to the first plane, the second surface offset from the top surface in a direction substantially perpendicular to the first and second planes, a plurality of bottom surfaces, and a plurality of side surfaces, the plurality of bottom surfaces comprising:

a first bottom surface configured to rest on a substantially horizontal surface and occupying a third plane substantially parallel to the first and second planes, and a plurality of elevated bottom surfaces comprising at least one inclined surface and at least one surface occupying a plane substantially parallel to the first, second, and third planes.

17. The method of claim 16, further comprising:

positioning a central gauge panel between the first end gauge panel and the second end gauge panel.

18. The method of claim 16, wherein the first end gauge panel and the second end gauge panel each comprise contoured side surfaces that mateably interface.

* * * * *